US005769339A

United States Patent [19]

Karra

[11] Patent Number: 5,769,339

[45] Date of Patent: Jun. 23, 1998

[54] CONICAL GYRATORY MILL FOR FINE OR REGRINDING

[75] Inventor: Vijia Kumar Karra, Franklin, Wis.

[73] Assignee: Nordberg, Inc., Wis.

[21] Appl. No.: 754,925

[22] Filed: Nov. 22, 1996

[51] Int. Cl.[6] ..... B02C 2/00; B02C 17/14

[52] U.S. Cl. ..... 241/175; 241/179; 241/184; 241/216

[58] Field of Search ..... 241/207–216, 241/172, 171, 184, 175, 179

[56] References Cited

U.S. PATENT DOCUMENTS

| | | | |
|---|---|---|---|
| 2,540,358 | 2/1951 | Symons | 241/216 |
| 3,454,230 | 7/1969 | Allen | 241/214 |
| 4,225,092 | 9/1980 | Matter et al. | 241/172 |
| 4,359,208 | 11/1982 | Kelm et al. . | |
| 4,384,684 | 5/1983 | Karra . | |
| 4,560,113 | 12/1985 | Szalanski . | |
| 4,575,014 | 3/1986 | Szalanski et al. . | |
| 4,620,185 | 10/1986 | Plahmer . | |
| 4,658,638 | 4/1987 | Plahmer . | |
| 4,659,026 | 4/1987 | Krause et al. . | |
| 4,703,896 | 11/1987 | Fabian et al. | 241/172 |
| 4,733,825 | 3/1988 | Boyes et al. | 241/175 |
| 4,756,484 | 7/1988 | Bechler et al. . | |
| 4,956,078 | 9/1990 | Magerowski et al. . | |
| 5,029,761 | 7/1991 | Bechler . | |

*Primary Examiner*—Mark Rosenbaum
*Attorney, Agent, or Firm*—Foley & Lardner

[57] ABSTRACT

A conical gyratory mill for regrinding, milling or fine pulverization of materials, having a milling media, such as milling balls, located in the milling space between a milling bowl and a milling head. The material to be milled is introduced into the top of the milling space and is milled as it descends through the milling space by interaction with the milling balls, milling bowl and head. A fluid is introduced at the bottom of the milling space and is discharged at the top of the milling space, carrying with it material which has been milled to the desired degree of fineness.

20 Claims, 2 Drawing Sheets

CONICAL GYRATORY MILL FOR FINE OR REGRINDING

CROSS REFERENCE TO RELATED APPLICATIONS

The present application is related to U.S. patent application Ser. No. 08/754,854, filed on an even date herewith by Karra, entitled, "Conical Gyratory Grinding And Crushing Apparatus"; and U.S. patent application Ser. No. 08/754,924, filed on an even date herewith by Karra, entitled, "High Reduction Ratio Crushing In Conical/Gyratory Crushers".

FIELD OF THE INVENTION

The present invention generally relates to mills for regrinding, milling, or fine pulverization of materials. More specifically, the present invention relates to a conical gyratory mill particularly adapted for regrinding, milling or fine pulverization of materials.

BACKGROUND OF THE INVENTION

Several different types of mills have been designed in the past and are currently used for regrinding, milling and fine pulverization of materials. While each type of prior art mill has certain advantages, they also have recognized short comings. For instance, tumbling ball mills are recognized to be energy inefficient. Vibratory ball mills are recognized to have low capacities, while vertimills (stirred ball mills) are recognized to be wear intensive and have a lower grinding efficiency toward the axis of rotation, since the shear velocity drops off from periphery to center.

Therefore, it has been found to be desirable to provide a more energy efficient, and higher volume mill, which has a more uniform milling or grinding efficiency throughout its milling or grinding cavity. It is also desirable that the mill be of simplified construction, be relatively easy to operate, and be readily maintained and repaired when necessary.

SUMMARY OF THE INVENTION

In accordance with an aspect this invention a conical gyratory mill for regrinding, milling, or fine pulverization of materials is provided which is more energy efficient, which can mill a greater volume of material in proportion to its size, and which has a more uniform milling efficiency throughout its milling cavity.

A conical gyratory mill in accordance with this invention is provided which has a bowl and a head, both of which are frustroconically shaped and are of a smaller diameter at the top than at the bottom. The conical head does not rotate within the conical bowl. A milling space is formed between the inner surface of the conical bowl and the outer surface of the conical head. The milling space is essentially filled with crushing balls of appropriate size and material.

The conical head is provided with a convex bottom which is supported on a base and driven by an eccentric which causes it to gyrate. The conical bowl is also provided with a convex bottom which extends partially under and is located close to the convex bottom of the conical head. The convex bottom of the conical bowl has a hole at its center. A flexible seal is provided between edge of the hole in the conical bowl and the convex bottom of the conical head. The flexible seal prevents any material from the milling space which enters the narrow gap between the convex bottoms, from escaping through the gap.

Material to be milled or reground enters the milling space through an inlet opening in the top of the conical bowl, which opening is centered over the top of the conical head. As the material to be milled or reground works its way down through the milling balls, it is milled or pulverized.

A supply of pressurized fluid, such as air or water, enters the milling space through apertures located directly below the milling space in the convex bottom of the conical bowl. The supply of pressurized fluid causes the material which has been milling or reground to the desired degree of fineness to be lifted by the fluid flow, and discharged from the milling space through an outlet surround the inlet opening at the top of the conical bowl. By adjusting the pressure and rate of flow of the fluid, the fineness of the material exiting the mill is controlled. The greater the pressure and rate of flow, the greater the coarseness of the material which will be discharged from the milling space. Or, the lesser the pressure and rate of flow, the finer the material which will be discharged from the milling space.

The present invention relates to a mill including a main support member, a conical bowl, and a conical head. The conical bowl is supported on the main support member and has a top, a bottom and an inner milling surface. The conical head is positioned within the conical bowl and has a top, a bottom and an outer milling surface. The outer milling surface of the conical head is spaced apart from the inner milling surface of the conical bowl to form a milling space therebetween wherein material can be introduced into the milling space. A flexible seal is secured between the bottom of the head and the bottom of the bowl to inhibit discharge of material from the milling space. A milling media is provided in the milling space such that the gyration of the conical head in the conical bowl causes the milling media to mill the material in the milling space.

The present invention also relates to a mill including a crushing head, a bowl and a sealing means. The crushing head has an exterior crushing surface, and the bowl has an interior crushing surface. The interior crushing surface and the exterior crushing surface define a milling cavity. The sealing means inhibits the removal of material from a bottom of the milling cavity. Milling media is disposed in the milling cavity.

The present invention further relates to a mill including a main support member, a conical bowl supported on the main support member, a conical head positioned within the conical bowl, a gyration assembly, a flexible seal, and a milling media. The conical bowl has an inner milling surface and the conical head has an outer milling surface. The outer milling surface of the conical head is spaced apart from the inner milling surface of the conical bowl to form a milling space therebetween. The gyration assembly supports the conical head on the main support member for gyration with respect to the conical bowl. The conical bowl has a top with a first opening in the top for introducing material to be milled into the milling space. The conical bowl and the conical head each have a bottom which are spaced apart from each other to permit gyration of the conical head with respect to the conical bowl. The flexible seal is secured to each of the bottoms to prevent the discharged material from the milling space between the bottoms. The bottom of the conical bowl has at least one opening therethrough which a fluid may be directed into the milling space. The milling media is provided in the milling space such that the gyration of the conical head in the conical bowl causes the milling media to mill the material to be milled. The fluid directed into the milling space is discharged from the milling space via a second opening at the top of the conical bowl carrying with it the material which has been milled to a desired degree of fineness.

DETAILED DESCRIPTION OF THE PREFERRED EMBODIMENTS

Figure 1:
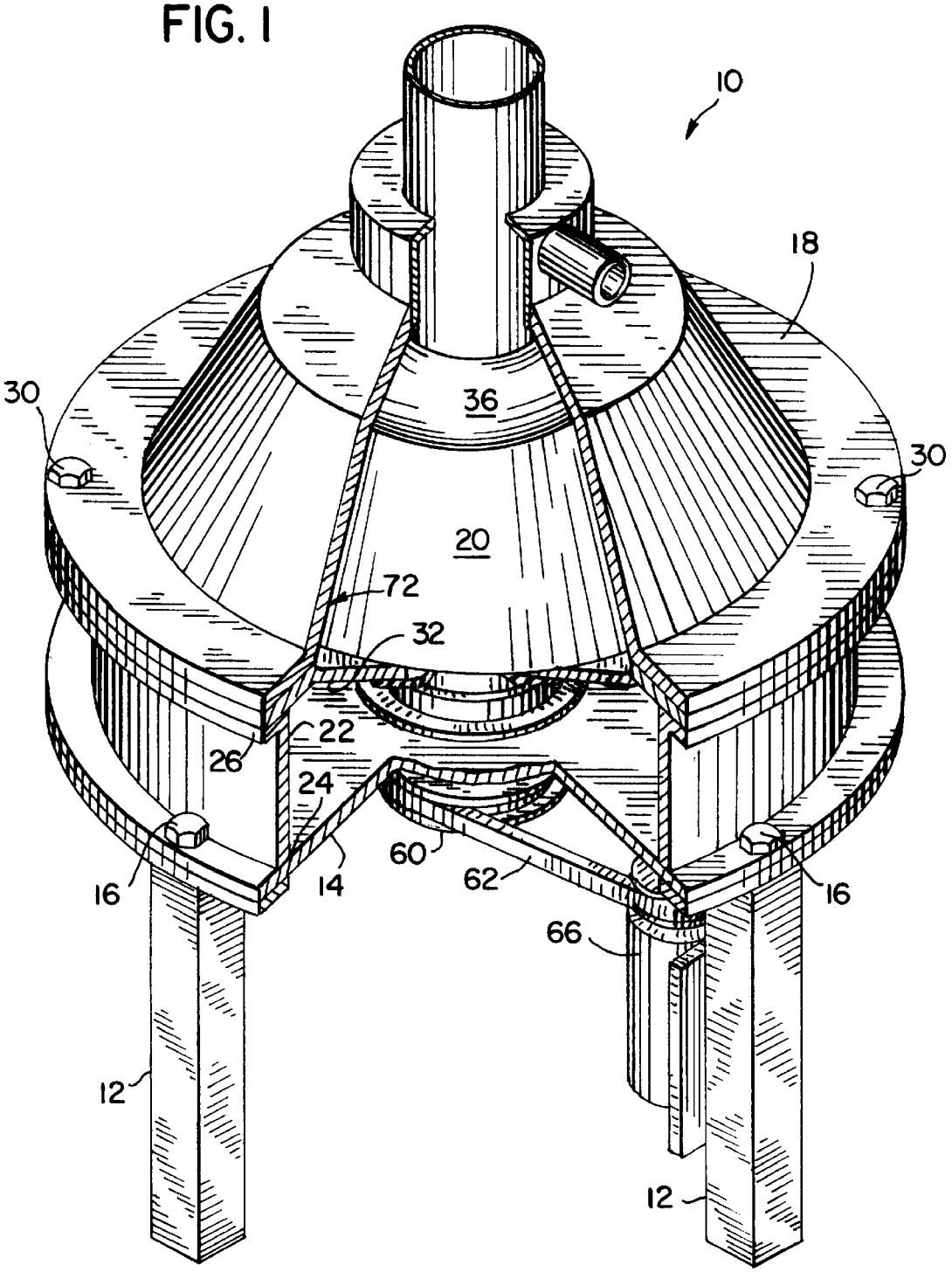
FIG. 1 is a perspective view, with a portion shown in section, of a conical gyratory mill constructed in accordance with an exemplary embodiment of the invention.
Figure 2:
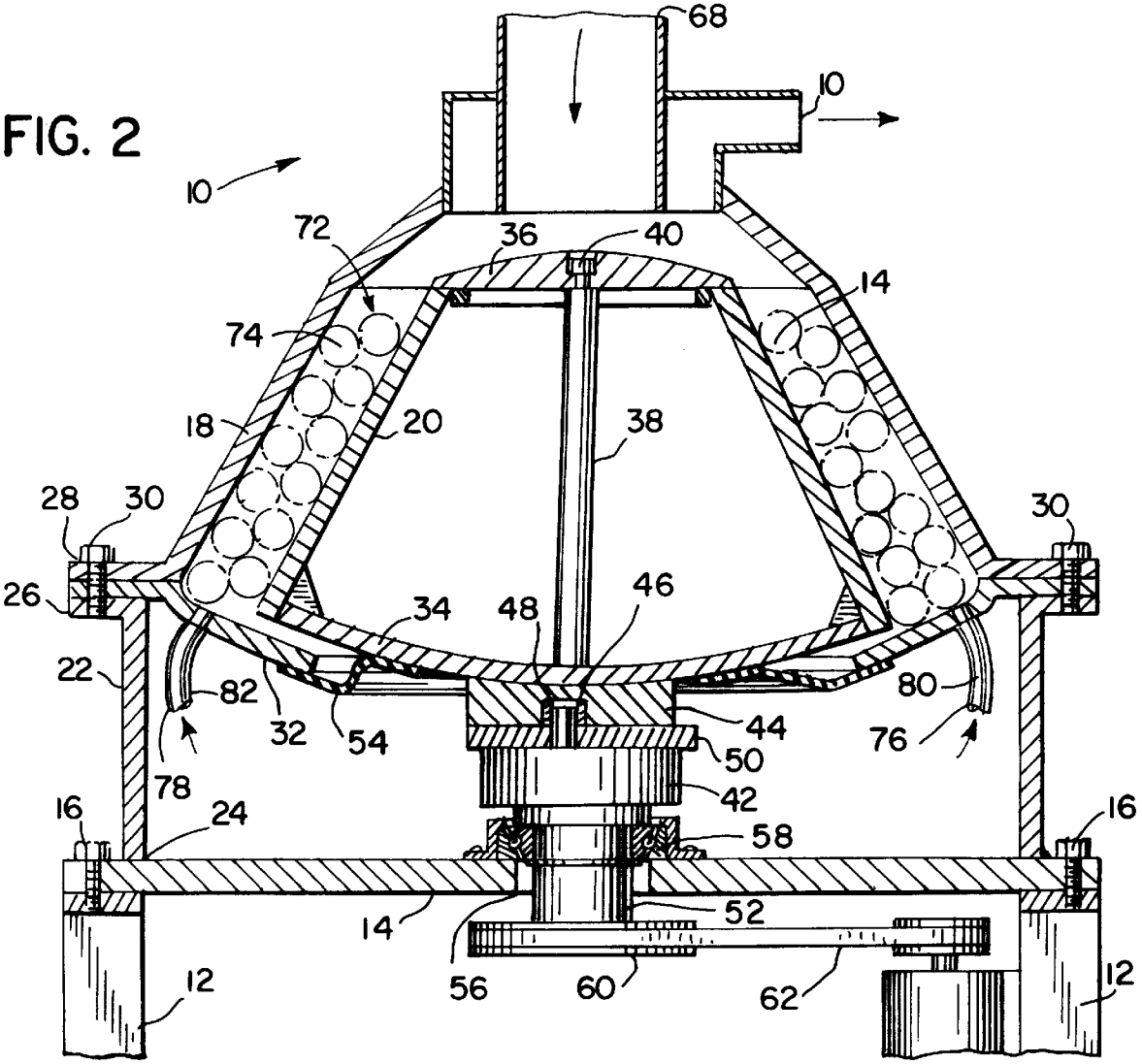
FIG. 2 is a cross-sectional view of a conical gyratory mill constructed in accordance with an exemplary embodiment of the invention as shown in FIG. 1.

Referring to FIGS. 1 and 2, the preferred embodiment of this invention will be described. A conical grinder or gyratory mill 10 in accordance with this invention is shown supported on foundation pillars 12. The mill is assembled on a main support member or bottom plate 14. The bottom plate 14 is secured to the foundation pillars 12 by fasteners or anchoring devices such as bolts 16. While the mill is shown supported on pillars 12, it may be supported in any other suitable manner.

The mill includes a frustroconically shaped downwardly spreading outer milling member 18 and a conically shaped downwardly spreading inner milling member 20. The outer milling member 18 is supported from the bottom plate 14 by a cylindrical wall member 22 which is welded at its lower end 24 to the bottom plate 14 and is provided with a flange 26 at the top. The flange 26 is provided with apertures 28 therein, located to coincide with apertures formed in the outer milling member 18, to receive fasteners or bolts such as bolts 30 to secure the outer milling member 18 to the cylindrical wall member 22. Also secured by the bolts 30 to the cylindrical wall member 22 is a convex outer bottom member 32, which extends inwardly and downwardly under the inner milling member 20. Member 18, plate 14, a liner (not shown) for member 18, and the main frame of crusher 10 each, alone or in combination can be considered as a bowl assembly.

Referring particularly to FIG. 2, the inner milling member 20, which is commonly referred to in crushers as a mantle, is supported along its lower edge on a convex inner bottom member 34. A cap 36 engages the top edge of the inner milling member 20, and is secured to the inner milling member 20 and the convex inner bottom member 34 by a securing device 38 in the form of a rod. The rod 38 is secured at its lower end to the bottom plate 34, such as by welding, and is provided with a threaded hole at its upper end. A fastener 40, in the form of a bolt, engages the threaded hole and presses on a counter sunk hole which surrounds a hole through which the rod passes in the cap 36.

The conically shaped inner milling member 20 is supported on a gyratory mechanism which includes a lower drive member 42 and an upper drive member 44. The upper drive member 44 is secured to the convex inner bottom member 34. A drive pin 46 projects upwardly from the lower drive member 42, and is received in an aperture 48 in the upper drive member 44. A bearing arrangement 50 is interposed between the upper surface of lower drive member 42 and the lower surface of upper drive member 44 to permit the upper and lower drive members to rotate and gyrate with respect to each other. The lower drive member 42 is secured to and supported on the upper end of a shaft 52 for rotation therewith. The longitudinal axis of the cylindrical drive pin 46 is offset from the longitudinal axis of shaft 52, such that as shaft 52 rotates, drive pin 46 rotates in a circle about the longitudinal axis of shaft 52. Aperture 48, in upper drive member 44, is aligned with the axis of rod 38 and the longitudinal axis of inner milling member 20. The rotational movement, about the axis of shaft 52, of drive pin 46, which is received in aperture 48, causes the inner milling member 20 to gyrate with respect to the outer milling member 18. The outer bottom member or plate 32 has a curvature towards the outer periphery which matches the curvature and eccentric motion of the inner bottom member 34.

In accordance with usual design practices, all surfaces in contact with the media or milling balls 74 and the feed material should be formed of a wear resistant material or covered with appropriate wear resistant linings. The media or milling balls 74 also can be made or coated with sear resistant material.

The inner milling member is prevented from rotating by a flexible circular shaped bellows or sealing member 54 which is secured along its outer edge to the edge of a central hole formed in the convex outer bottom member 32 and along its inner edge to the convex inner bottom member 34. The sealing member 54 has enough stretch in it to take up the displacement of the gyrating inner bottom member 34 with respect to the outer bottom member 32.

The shaft 52 passes through an aperture 56 formed in the bottom plate 14 and is supported for rotation therein by a bearing 58. Attached to the lower end of the shaft 52 is a pulley 60. The pulley 60 is driven by a belt 62 which engages a pulley 64 driven by a prime mover 66, such as an electric motor. While a pulley and belt drive system is shown, other types of drive systems could be used, such as a hydraulic drive. Other mechanical arrangements could be provided to cause the inner milling member to gyrate with respect to the outer milling member. The disclosed arrangement for causing gyration is only presented as one example of numerous arrangements which could be used to provide gyration.

Secured to the upper end of outer milling member 18 are a pair of concentric cylindrical tubes 68 and 70, which open into a milling space 72 formed between the outer and inner milling members. The milling space 72 is essentially filled with media, preferably milling balls 74 formed of suitable steel or a wear resistant material such as steel or a ceramic material. The inner cylindrical tube 68 is used as a passage to deposit material to be milled into the milling space 72. The outer cylindrical tube 70 is used as a passage through which material milled to the desired degree of fineness is discharged from the crushing space, by a pressurized fluid flow. The pressurized fluid enters the milling space 72 through apertures 76 and 78 formed in the convex outer bottom member 32 directly under the milling space. A plurality of tubes 80 and 82, shown connected to the apertures 76 and 78, are used to provide the flow of pressurized fluid through the crushing space. While only a pair of apertures and tubes are shown, any number could be provided. Apertures 76 and 78, and tubes 80 and 82 are preferably disposed about the entire circumference of the milling space. Apertures 76 and 78 can be disposed in a ring provided under the milling space.

Turning to the operation of the conical gyratory mill, material to be milled is fed into the inner cylindrical tube 68 onto the cap 36. The feed material then falls into the milling space 72 along the outer surface of the inner milling member 20. The feed material can be up to 4 mesh but preferably is 35 mesh or finer. As the material descends through the milling space, it passed between the milling balls 74. The milling balls are caused to move with respect to each other by the gyration of the inner milling member 20 with respect to the outer milling member 18. The milling balls 74, being stirred in both the upward and radial directions provide greater efficiency in milling the feed material deposited in the milling space. The pressurized fluid which enters the milling space 72 through the apertures 76 and 78, carries milled material upward to the outer cylindrical tube 70, where it is discharged with the fluid from the crushing space. The pressure and rate of flow of the fluid is regulated to provide for the discharge of milled material with the desired degree of fineness.

Gyrating motion of the mill of this invention, which causes both upward and radial displacement in the milling space 73 of the milling balls 74 and the milled feed material uses much less energy compared to that used by vertimills where the rotor has to "cut" through a packed bed of media. The gyratory motion of the mill of this invention also avoids the radial "shearing" gradient associated with vertimills. Capacities achievable with mill of this invention will be higher as vibration limits the maximum sizes of the vibrating mills. Tumbling mills break the particles by random loading and in the mill of this invention the loading is more deterministic.

While one embodiment of the invention have been shown, it should be apparent to those skilled in the art that what has been described is considered at present to be a preferred embodiment of the conical gyratory mill for regrinding, milling and fine pulverization of materials. In accordance with the Patent Statute, changes may be made in the gyratory mill without actually departing from the true spirit and scope of this invention. The appended claims are intended to cover all such changes and modification which fall in the true spirit and scope of this invention.

What is claimed is:

1. A mill, comprising:

a main support member;

a conical bowl supported on the main support member, the conical bowl having an inner milling surface;

a conical head positioned within the conical bowl, the conical head having an outer milling surface, the outer milling surface of the conical head being spaced from the inner milling surface of the conical bowl to form a milling space therebetween;

a gyration assembly supporting the conical head on the main support member for gyration with respect to the conical bowl;

wherein the conical bowl has a top, with a first opening in the top for introducing material to be milled into the milling space, the conical bowl and the conical head each having a bottom, the bottoms spaced from each other to permit gyration of the conical head with respect to the conical bowl;

a flexible seal secured to each of the bottoms to prevent the discharge of material from the milling space between the bottoms, the bottom of the conical bowl having at least one opening therein through which a fluid may be directed into the milling space; and a milling media provided in the milling space, such that the gyration of the conical head in the conical bowl causes the milling media to mill the material to be milled, wherein the fluid directed into the milling space is discharged from the milling space via a second opening at the top of the conical bowl, carrying with it the material which has been milled to a desired degree of fineness.

2. The mill of claim 1, wherein the first and second openings in the top of the conical bowl are cylindrical and concentric with each other, with the first opening being located within the second opening.

3. The mill of claim 2, wherein the first and second openings are located in the center of the top.

4. The mill of claim 1, wherein the milling media is forced upward as the gyration of the head narrows the width of the milling space, and thereafter falls down as the milling space increases.

5. The mill of claim 1, wherein the flexible seal prevents the conical head from turning with respect to the conical bowl.

6. The mill of claim 1, wherein the milling media is formed of balls.

7. The mill of claim 6, wherein the balls are formed of a suitable wear resistant steel or a ceramic material.

8. The mill of claim 1, wherein the bottom of the conical bowl has a hole formed centrally therein, and the flexible seal is circular and secured to the bottom of the conical bowl adjacent the edge of the hole.

9. A mill, comprising:

a main support member;

a conical bowl supported on the main support member, the conical bowl having a top, a bottom, and an inner milling surface;

a conical head positioned within the conical bowl, the conical head having a top, a bottom and an outer milling surface, the outer milling surface of the conical head being spaced from the inner milling surface of the conical bowl to form a milling space therebetween; wherein material can be introduced into the milling space;

a flexible seal secured between the bottom of the head and the bottom of the bowl to inhibit discharge of material from the milling space; and a milling media provided in the milling space, such that gyration of the conical head in the conical bowl causes the milling media to comminute the material in the milling space.

10. The mill of claim 9, wherein a first opening and a second opening in the top of the conical bowl are cylindrical and concentric with each other, with the first opening being located within the second opening.

11. The mill of claim 10, wherein the first and second openings are located in the center of the top of the bowl.

12. The mill of claim 9, wherein the milling media is forced upward as the gyration of the head narrows the width of the milling space, and thereafter falls down as the milling space increases.

13. The mill of claim 9, where the flexible seal prevents the conical head from turning with respect to the conical bowl.

14. The mill of claim 9, wherein the milling media is formed of balls.

15. The mill of claim 14, wherein the balls are formed of steel or a suitable ceramic material.

16. The mill of claim 9, wherein the bottom of the conical bowl has a hole formed centrally therein, and the flexible seal is circular and secured to the bottom of the conical bowl adjacent the edge of the hole.

17. A mill, comprising:

a crushing head having an exterior crushing surface;

a bowl having an interior crushing surface, the interior crushing surface and the exterior crushing surface defining a milling cavity;

a sealing means for inhibiting the crushing head from turning with respect to the bowl; and a milling media disposed in the milling cavity.

18. The mill of claim 17 wherein the sealing means includes rubber.

19. The mill of claim 17 wherein the material enters and leaves the milling cavity through a top.

20. The mill of claim 19 wherein the milling cavity has a plurality of openings at the top.

* * * * *